US007942406B2

(12) United States Patent
Ootaki

(10) Patent No.: US 7,942,406 B2
(45) Date of Patent: May 17, 2011

(54) ROLL FEEDER

(75) Inventor: Youichi Ootaki, Kawaguchi (JP)

(73) Assignee: Hinix Co., Ltd., Tokyo (JP)

( * ) Notice: Subject to any disclaimer, the term of this patent is extended or adjusted under 35 U.S.C. 154(b) by 163 days.

(21) Appl. No.: 12/196,617

(22) Filed: Aug. 22, 2008

(65) Prior Publication Data

US 2010/0044946 A1 Feb. 25, 2010

(51) Int. Cl.
*B65H 29/32* (2006.01)

(52) U.S. Cl. ..... 271/197

(58) Field of Classification Search ..... 271/194, 271/196, 197; 83/100, 155
See application file for complete search history.

(56) References Cited

U.S. PATENT DOCUMENTS 5,275,394 A * 1/1994 Mank et al. ..... 271/183
6,494,452 B1 * 12/2002 Karasiewicz ..... 271/276

FOREIGN PATENT DOCUMENTS

JP 2005-520756 7/2005
WO WO 03/080490 10/2003

* cited by examiner

*Primary Examiner* — Stefanos Karmis
*Assistant Examiner* — Michael C McCullough
(74) *Attorney, Agent, or Firm* — Young & Thompson

(57) ABSTRACT

A roll feeder reliably produces sheets obtained by cutting a web, as a pack of sheets arranged in a partially overlapping fashion with a quantity of overlap margin of the sheet suitable for use with a printing press and capable of easily controlling overlap. A roll feeder includes a rotary cutter for cutting a web to obtain cut sheets, a lower suction and conveyance belt element for sucking and conveying the sheets cut by the rotary cutter, a lift member for raising upwardly the tail edge of the cut sheet sucked and conveyed by the lower suction and conveyance belt element, and an upper suction and conveyance belt element for sucking the tail edge of the cut sheet raised by the lift member from above and conveying the cut sheet at a speed lower than the speed at which the lower suction and conveyance belt element conveys the cut sheet.

2 Claims, 4 Drawing Sheets

ROLL FEEDER

FIELD OF THE INVENTION

The present invention relates to a roll feeder for producing sheets obtained by cutting a web or the like in a partially overlapping fashion.

There is known a roll feeder for cutting a web into individual sheets and for arranging the cut sheets in a partially overlapping fashion.

The roll feeder described above is, for example, disclosed in TOKUHYO 2005-520756.

The roll feeder disclosed in TOKUHYO 2005-520756 comprises a first conveyance member 61 for conveying a sheet 60, a second conveyance member 62 for conveying the sheet 60 at a less speed than the speed at which the first conveyance member 61 conveys it, a sheet feeding roller 63 for feeding the sheet 60 from the first conveyance member 61 to the second conveyance member 62, a forming roller 64 for producing a gap at the tail end of the cut sheet in cooperation with the sheet feeding roller 63, and a regulation block member 65 for regulating a bending quantity of the sheet 60. The gap is produced at the tail end of the sheet 60 due to the positions of the sheet 60, the sheet feeding roller 63, the forming roller 64, and the regulation block member 65 in engagement with each other. In this fashion, the subsequent sheet is fed into the gap produced at the tail end of the sheet.

PROBLEM TO BE SOLVED BY THE INVENTION

However, there is not so sufficient gap produced at the underside of the sheet if only the sheet feeding roller and the forming roller raise the tail end of the sheet. Moreover, if only the sheet is conveyed to the second conveyance member having a less speed than the first conveyance member, the sheet cannot sufficiently be applied with braking. Therefore, it is difficult to arrange a plurality of sheets in a partially overlapping fashion with a fixed and constant quantity of overlap margin, and much time, efforts and troublesome operations are required to control the quantity of overlap margin.

It is therefore an object of the present invention to provide a roll feeder capable of reliably producing sheets obtained by cutting a web, as a pack of sheets arranged in a partially overlapping fashion with a quantity of overlap margin of the sheet suitable for use with a printing press and capable of easily controlling the quantity of overlap margin of the sheet.

SUMMARY OF THE INVENTION

In order to solve the above problem, a roll feeder includes: a rotary cutter 23 for cutting a web 4 to obtain cut sheets 5; a lower suction and conveyance belt means 31 for sucking and conveying the sheets cut by the rotary cutter; a lift member 38 for raising upwardly a tail edge of the cut sheet sucked, and conveyed by the lower suction and conveyance belt means; and an upper suction and conveyance belt means 40 for sucking the tail edge of the cut sheet raised by the lift member from above and conveying the cut sheet at a speed less than the speed at which the lower suction and conveyance belt means conveys the sheet.

A roll feeder further includes a stop member 46 for temporarily holding a lead edge of the cut sheet conveyed by the upper suction and conveyance belt means to halt the conveyance of the sheet.

A roll feeder furthermore includes a controller for controlling the speeds at which, respectively, the lower suction and conveyance belt means and the upper suction and conveyance belt means convey the cut sheet, wherein a quantity of overlap margin of the cut sheet, with which a plurality of cut sheets partially overlap on each other, can be controlled along the conveying direction.

Accordingly, it is possible to reliably produce a serial pack of sheets arranged in a partially overlapping fashion with a desired quantity of overlap margin of the sheet. In addition, it is possible to easily control the quantity of overlap margin of the sheet.

DETAILED DESCRIPTION

A preferred embodiment will be described below with reference to the drawings.

The roll feeder 100 of an embodiment according to the present invention cuts a web 4 into sheets 5 having a prescribed shape, and conveys the cut sheets 5 as a serial pack of sheets arranged in a partially overlapping fashion with a desired quantity of overlap margin. Incidentally, a sheet 5 of the embodiment applies to the cut sheet according to the invention.

Figure 1:
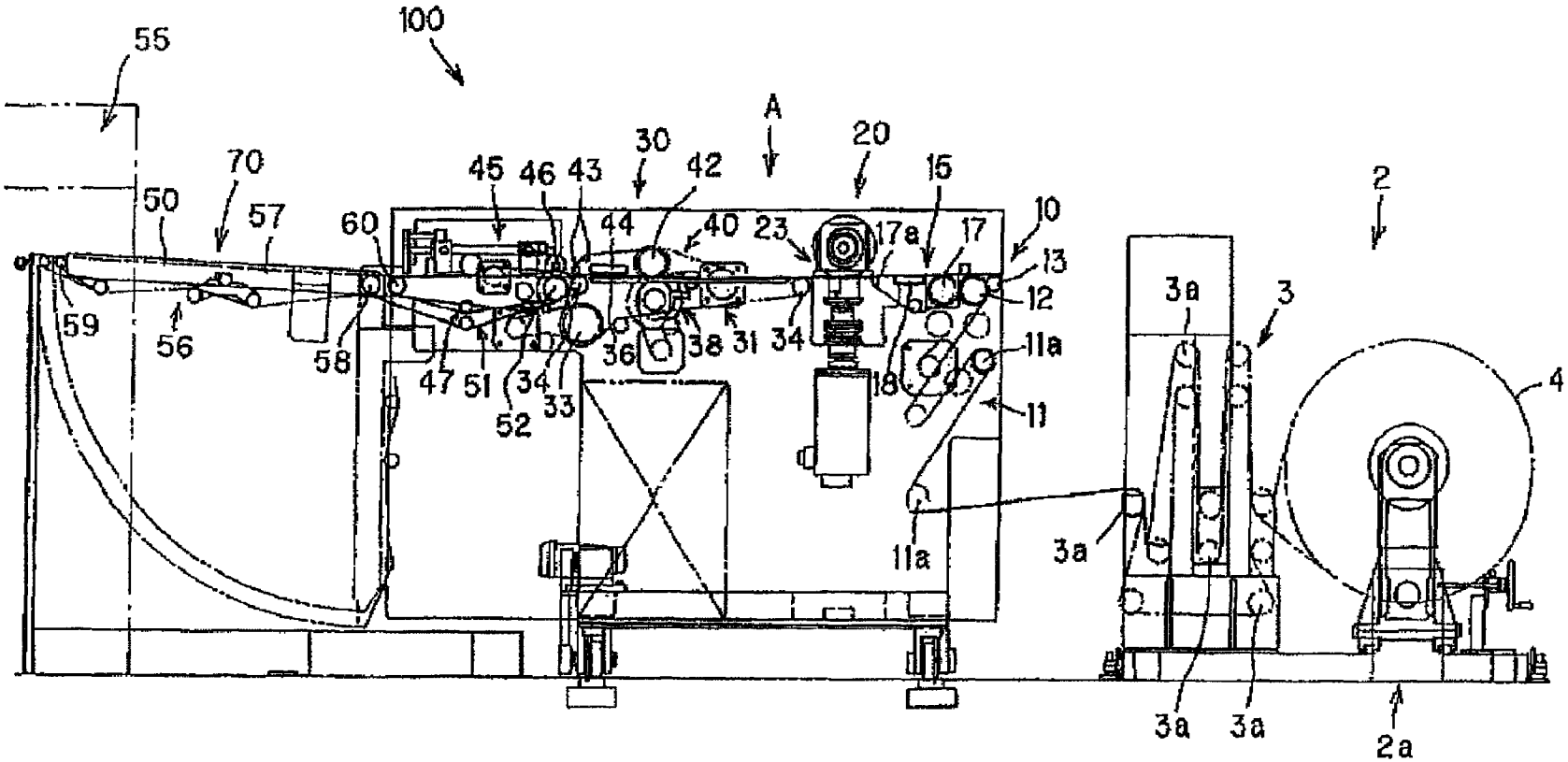
FIG. 1 is a view showing the whole structure of the roll feeder according to the present invention.

The roll feeder 100, as shown in FIG. 1, comprises an infeed unit 10 for conveying the web 4 to a cutter unit 20, the cutter unit 20 for cutting the web 4 into sheets 5 having a prescribed shape, an overlap forming unit 30 for forming a plurality of sheets 5 into a serial pack of sheets arranged in a partially overlapping fashion with a desired quantity of overlap margin, and a conveyer 70, and feeds the serial pack of sheets to a feeder 55 of the printing press.

The web 4 is provided at a reel-stand unit 2. The Reel-stand unit 2 includes a reel-stand 2*a* for holding a roll of web 4, and a group of rollers 3 having a number of rollers 3*a* for guiding the web 4 to be conveyed to the roll feeder 100. The web 4 continues to the infeed unit 10 of the roll feeder 100 via the group of rollers 3.

The infeed unit 10 includes a group of guide rollers 11 having a plurality of guide rollers 11*a* for guiding the web 4 conveyed from the reel-stand 2*a*, a suction roller 12 rotated by a driving unit such as a motor not shown, a nip roller 13 for pressing the web onto the surface of the suction roller 12 evenly in the entire width of the web 4, and a first suction and conveyance belt means 15 for sucking, from below, the web guided to the suction roller 12 and conveying the web to a cutter unit 20. The web 4 is stably conveyed to the cutter unit 20 with its entire back surface being sucked by the first suction and conveyance belt means 15.

Figure 2:
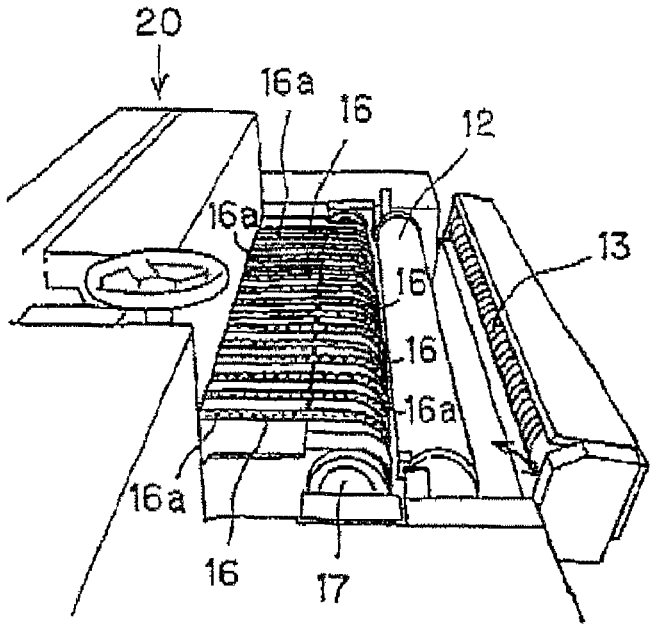
FIG. 2 is a view showing the structure of the infeed unit.

The first suction and conveyance belt means 15 has, as shown in FIG. 2, thin and strong endless belts 16, each of which is provided with many small holes 16*a* for ventilation at a predetermined pitch in its longitudinal direction in order to suck the web 4 from its underside and convey it to the left direction in FIG. 1 at a given speed. The plural belts 16 are disposed in parallel along a traveling direction of the web 4. As shown in FIGS. 1 and 2, the belts 16 are set between a drive shaft 17 and a sub shaft 17*a*, which are located perpendicularly to the traveling direction of the web 4, so that the belts 16 come into contact with the lower surface of the web 4. Further, a suction box 18 is arranged at a location defined by the belts 16 and has suction inlets (not shown) provided facing the backside of the web 4 at a location where the belts 16 are to come into contact with the web. From the suction box 18 is discharged air by a blower connected through a duct (not shown). The drive shaft 17 is rotatably disposed between the right and left frames not shown of the roll feeder 100 and supplied with a power independently from a driving unit like a motor. The suction box 18 is fixed to the frames, and the sub shaft 17*a* is rotatably supported by the frames.

By this construction of the infeed unit 10, the web 4 passes through the guide rollers 11*a* and is sucked by the suction roller 12, then comes to the first suction and conveyance belt means 15, and is further sucked by the second suction and conveyance belt means 31, as described later, and conveyed to the cutter unit 20 to be cut.

It may also be preferable that the first suction and conveyance belt means 15 is arranged so as to come into contact with the upper surface of the web 4. Further, the first suction and conveyance belt means 15 may be omitted and the web 4 may be fed directly from the suction roller 12 to the cutter unit 20.

Figure 4:
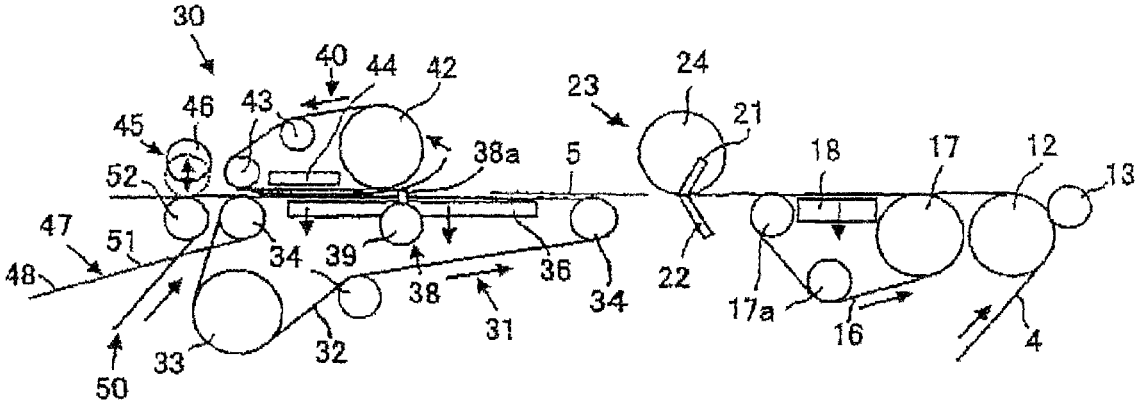
FIG. 4 is an enlarged view briefly showing the part as designated by A in FIG. 1.
Figure 5:
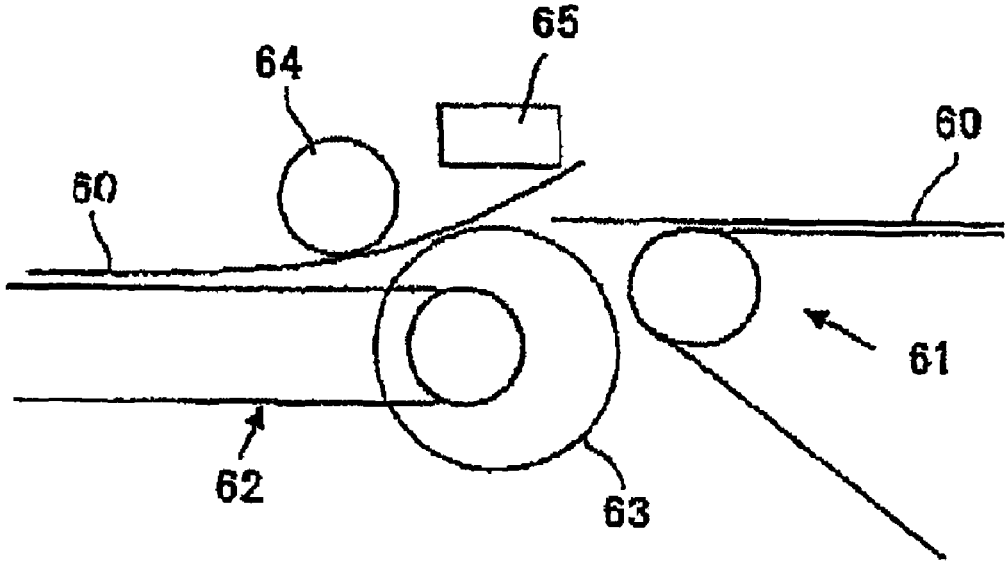
FIG. 5 Prior Art
FIG. 5 is a view briefly showing the structure of a conventional roll feeder.

The cutter unit 20 includes, as shown in FIGS. 1 and 4, a rotary cutter 23 having a rotary blade 21 and a fixed blade 22. The rotary cutter 23 cuts the web 4 conveyed by the first suction and conveyance belt means 15, with a given size. The fixed blade 22 is fixed to the above-mentioned frames not shown so as to come into contact with the lower surface of the web 4 conveyed from the first suction and conveyance belt means 15. On the other hand, the rotary blade 21 is fixed on a rotary cylinder 24 so as to periodically come across the fixed blade 22 from the upper side of the web 4. The fixed blade 22 has its one end moved to either the upstream side or downstream side of the traveling direction of the web depending on a rotation number of the rotary cylinder 24 having the rotary blade 21 fixed thereon so that the position of the fixed blade 22 can be adjusted. The position of the fixed blade 22 may also be automatically adjusted by a controller not shown based on the rotation number of the rotary cylinder 24 having the rotary blade 21 fixed thereon.

A sheet 5 cut by the cutter unit 20 is conveyed to an overlap forming unit 30. As shown in FIGS. 1 and 4, the overlap forming unit 30 includes the second suction and conveyance belt means 31 for sucking the cut sheet 5 from below to convey it to the downstream side, a lift member 38 for raising upwardly the tail edge of the sheet 5 being conveyed, a third suction and conveyance belt means 40 for sucking the tail edge of the sheet raised by the lift member 38 from above to receive and convey it to the downstream side, and a stopper unit 45 for temporarily holding the lead edge of the sheet 5 to temporarily halt the conveyance of the sheet 5.

Figure 3:
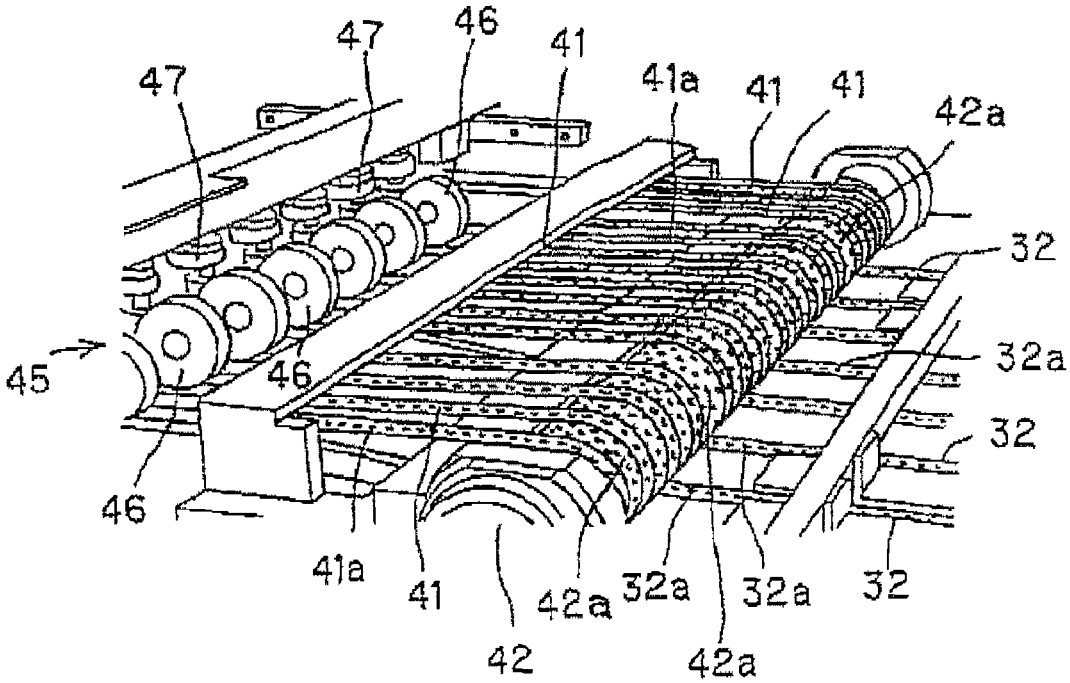
FIG. 3 is a view showing the structure of the overlap forming unit.

The second suction and conveyance belt means 31 receives the lead edge of the web 4 immediately before the rotary cutter 23 cuts the web 4, and sucks the web 4 in cooperation with the first suction and conveyance belt means 15. After the rotary cutter 23 cuts the web 4, the second suction and conveyance belt means 31 conveys the cut-off sheet 5 to the left direction in FIG. 1. The second suction and conveyance belt means 31 is driven at a little higher speed than the speed at which the first suction and conveyance belt means 15 is driven. As shown in FIG. 3, the second suction and conveyance belt means 31 has thin endless belts 32 each provided with many small perforations 32*a* for ventilation, and the plurality of the belts 32 are disposed in parallel along the traveling direction of the sheet 5. The belts 32 are set between a drive shaft 33 and a sub shaft 34 located perpendicularly to the traveling direction of the sheet 5 so that the upper side of the moving belt comes into contact with the lower surface of the sheet 5. The belt 32 is driven at a slightly higher speed than the speed at which the belt 16 of the first suction and conveyance belt means 15 is driven. The drive shaft 33 is rotatably disposed between the right and left frames not shown of the roll feeder 100 and supplied with a power independently from a driving unit like a motor. The drive shaft 33 makes the belt 32 of the second suction and conveyance belt means 31 run at a slightly higher speed than the speed at which the belt 16 of the first suction and conveyance belt means 15 runs.

As shown in FIGS. 1 and 4, suction boxes 36 are arranged for each of the belts 32 of the second suction and conveyance belt means 31. Each suction box 36 has suction inlets (not shown) formed on its upper side at a location where to come across the backside of the sheet 5 being conveyed on the belts 32 of the second suction and conveyance belt means. The suction inlets are sequentially arranged along the traveling direction of the sheet 5 while their opening areas are decreasing from the upstream side toward the downstream side. Specifically, the suction inlets may be elongated perforations with their opening areas gradually decreasing, or the suction inlets may be circular openings disposed at gradually increasing pitches from the upstream side toward the downstream side. Accordingly, the suction force against the sheet 5 is gradually decreasing toward the downstream side, namely, gradually lowering the restricting force to the sheet 5. Each suction box 36 is connected to a blower (not shown) and air is exhausted by a sucking action of the blower.

The lift member 38 is, as shown in FIGS. 1 and 4, located at the downstream side of the second suction and conveyance belt means 31 and operates to raise the sheet 5 conveyed by the second suction and conveyance belt means 31 upwardly from the endless belt 32 of the second suction and conveyance belt means 31, as shown in FIG. 4. In the concrete, the lift member 38 comprises brushes 38*a* intermittently located on a drive shaft 39 set between the right and left frames not shown in order that the brushes 388 come in between the suction boxes 36 of the second suction and conveyance belt means 31. The lift member 38 may have a member like a cam other than the brushes 38*a*. When the sheet 5 is conveyed by the second suction and conveyance belt means 31, the brushes 38*a* of the lift member 38 abut upon the tail edge of the sheet 5 and se the tail edge off from the surface of the belts 32 of the second suction and conveyance belt means 31 against the suction force of the second suction and conveyance belt means 31. Since the suction inlets of the suction boxes 36 become smaller adjacently to the lift member 38, the suction force to the sheet is lowered and therefore the tail edge of the sheet 5 can easily be raised off from the belts 32 of the second suction and conveyance belt means 31. Thus raised tail edge of the sheet 5 is received by the third suction and conveyance belt means 40.

To be noted, in order to convey the sheet 5 more smoothly and reliably from the second suction and conveyance belt means 31 to the third suction and conveyance belt means 40, it is preferable to change the abutting position of the lift member 38 with the sheet 5 more or less depending on the quality of the sheet 5, the running speed of the sheet and the like. For this reason, a phase changing means for shifting the phase of the lift member 38 with regard to the sheet 5 is provided on the drive shaft 39. To the phase changing means, a known art may be applied and its detailed description is omitted here.

The third suction and conveyance belt means 40 comprises, as shown in FIGS. 3 and 4, endless belts 41, a drive shaft 42 and sub shaft 43. The drive shaft and the sub shaft make the belts 41 run along the traveling direction of the sheet 5.

The belts 41 of the third suction and conveyance belt means 40 are strong thin belts each having a number of small holes 41*a* for ventilation arranged at a predetermined pitch in the lateral and longitudinal directions similar to the belts 32 of the second suction and conveyance belt means 31. The plural belts 41 are disposed in parallel along the traveling direction of the sheet 5. The belts 41 are disposed so as to take the sheet 5 from above and run between a drive shaft 42 and a sub shaft 43. The drive shaft 42 of the former side and the sub shaft 43 of the latter side are perpendicular to the traveling direction of the sheet. The belts 41 run at a lower speed of approximately 1/10 to 1/20, for example, than the speed at which the endless belts 32 of the second suction and conveyance belt means 31 run. Further, a suction box 44 is disposed at a location defined by the belts 41, and suction inlets (not shown) of the suction box are provided at the location where the belts 41 are to come into contact with the sheet 5. From the suction box 44 is discharged air by a blower connected to the suction box 44 via a duct (not shown).

The drive shaft 42 of the former side comprises a sucking roller (suction roller, for example), the surface of which is perforated with a number of suction inlets 42*a*. The drive shaft 42 is located substantially just above the lift member 38. The drive shaft 42 is connected to a blower via a rotary joint (not shown) and adsorbs the sheet 5 on the belts 32 of the second suction and conveyance belt means 31 by sucking air from the suction inlets 42*a*. As shown in FIG. 4, when the lift member 38 raises the sheet 5 off from the belts 32 of the second suction and conveyance belt means 31, the tail edge of the sheet 5 is adsorbed to the surface of the drive shaft 42 via the belts 41 of the third suction and conveyance belt means 40.

Then, the sheet 5 is conveyed from the third suction and conveyance belt means 40 to a fourth conveying belt means 47 and thereafter conveyed to a fifth conveyance belt means 50 to be fed to a feeder 55 of the printing press. Above the former side of the fifth conveyance belt means 50 are located (a pressing member 46 of) a stopper unit 45.

The fourth conveying belt means 47 comprises, as shown in FIG. 1, endless belts 48, which are set between the sub shaft 34 of the second suction and conveyance belt means and a sub shaft 60. The fourth conveying belt means receives the sheet 5 from the third suction and conveyance belt means 40 and conveys it to the fifth conveyance belt means 50. The plural belts 48 are disposed in parallel along the traveling direction of the sheet 5. The belts 48 are disposed alternately with the belts 32 of the second suction and conveyance belt means 31 and conveying belts of the fifth conveyance belt means 50, as described later, in a direction perpendicular to the conveying direction.

The stopper unit 45 includes, as shown in FIG. 3, the pressing member 46 for pressing the conveying belts 51 of the fifth conveyance belt means 50 from above, and a support member 47 for supporting the pressing member 46. The support member 47 makes the pressing member 46 move vertically so as to abut against the conveying belts 51 or to be released from the conveying belts 51. The pressing member 46 suitably uses a rotary body made of an elastic material such as rubber. The support member 47 is controlled by a controller (not shown), which controls the pressing member 46 to move forward or backward depending on the size of paper.

The sheets produced by the overlap forming unit 30 as a serial pack of sheets arranged in a partially overlapping fashion with a predetermined quantity of overlap margin are conveyed onto a sixth conveyance belt means 56 by the fifth conveyance belt means 50.

The fifth conveyance belt means 50 includes, as shown in FIG. 2, endless belts 51, and a drive shaft 52 and a sub shaft 58 for setting the sheet 5 in its traveling direction. The belts 51 are strong thin belts and disposed in parallel along the traveling direction of the sheet 5. The belts 51 are disposed to receive the sheet 5 with its lower side and set between the drive shaft 52 of the former end side and the sub shaft 58 of the latter end side located perpendicularly to the traveling direction of; the sheet 5. The running speed of the belts 51 is the same as that of the belts of the third suction and conveyance belt means 40, for example.

The sixth conveyance belt means 56 on a conveyer 70 has the same construction as that of the fifth conveyance belt means 50. Specifically, the sixth conveyance belt means includes endless belts 57, and the sub shaft 58 of the fifth conveyance belt means 50 and a sub shaft 59 for setting the sheet 5 in its traveling direction. The sheet 5 conveyed from the fifth conveyance belt means 50 is fed to the feeder 55 of the printing press by the sixth conveyance belt means 56 on the conveyer 70. The conveyer may be permanently installed and more preferably mountable for operation in non-use time of the roll feeder.

To be noted, the second suction and conveyance belt means 31 of the embodiment functions as the lower suction and conveyance belt means of the invention and the third suction and conveyance belt means 40 functions as the upper suction and conveyance belt means of the invention. The pressing member 46 of the embodiment functions as the stop member of the invention.

Next, a sequence of operations of the roll feeder will be described with reference to the drawings of FIGS. 1 to 4.

First, the web 4 fed from the reel-stand unit 2 by means of the group of rollers 2*a* is conveyed to the infeed unit 10. At the infeed unit 10, driven by the suction roller 12, the web 4 is moved to the first suction and conveyance belt means 15 with its entire width nipped on the surface of the suction roller 12 by the nip roller 13 and conveyed to the cutter unit 20.

Subsequently, the web 4 is cut into sheets by the rotary cutter 23. In this cutting operation, the lead edge of the web 4 passes through the rotary cutter 23, which is just in a prior condition to cutting, and the web is received on the belts 32 of the second suction and conveyance belt means 31, and then conveyed to the downstream side with its lower side being suction n. Therefore, the web 4 is tensed by a suitable strength between the first suction and conveyance belt means 15 and the second suction and conveyance belt means 31. Immediately thereafter, the web 4 is cut into sheets by the rotary cutter 23.

The belts 32 of the second suction and conveyance belt means 31 runs at a slightly higher speed than the belts 16 of the first suction and conveyance belt means 15 runs, so that there is generated a clearance between the tail edge of the cut sheet 5 and the lead edge of the web 4. This makes it possible to prevent the tail edge of the preceding cut sheet 5 from colliding with the lead edge of the subsequent sheet 5.

When the cut sheet 5 is conveyed to the downside of the drive shaft 42 of the third suction and conveyance belt means 40 by the second suction and conveyance belt means 31, as shown in FIG. 4, the brushes 38*a* of the lift member 38 raises the tail edge of the sheet 5 off from the belts 32 of the second suction and conveyance belt means 31 against the attracting force Of the belts and presses it onto the drive shaft 42 of the third suction and conveyance belt means 40. The tail edge of the sheet 5 is attracted to the surface of the drive shaft 42 and bent in a curved shape of the surface.

The third suction and conveyance belt means 40 moves at a lower speed than the second suction and conveyance belt means 31 moves and therefore the sheet 5 is conveyed as being a serial pack of the sheets while the lead edge of the subsequent sheet 5 is going under the preceding sheet 5 and the subsequent sheet 5 partially overlaps with the preceding sheet 5.

The sheet 5 conveyed by the third suction and conveyance belt means 40 is passed to the fifth conveyance belt means 50 via the fourth conveyance belt means 47 and further conveyed to a palette 55, and then the lead edge of the sheet 5 temporarily held by the pressing member 46 of the stopper unit 45 located above the fifth suction and conveyance belt means 50. In this manner, the sheet 5 is conveyed onto the palette 55 as being a serial pack of sheets with a number of sheets arranged in a partially overlapping fashion while the quantity of overlap margin of the sheet is controlled.

The quantity of overlap margin in the serial pack of sheets can be easily controlled by a controller (not shown), which controls the rotational speeds of the drive shafts 33 and 42 of the second suction and conveyance belt means 31 and the third suction and conveyance belt means 40, respectively. In addition, it is possible to produce a serial pack of sheets arranged in a partially overlapping fashion with a desired quantity of overlap margin by controlling the timing far the pressing member 46 of the stopper unit 45 to hold the lead edge of the sheet 5, thereby reliably regulating the movement of the sheet 5.

To be noted, the present invention may not be limited to the above-mentioned embodiments but may also be carried out in various aspects.

EXPLANATION OF REFERENCE NUMERALS

4: web
5: sheet
23: rotary cutter
31: second suction and conveyance belt means
38: lifting member
40: third suction and conveyance belt means
46: pressing member
100: roll feeder

The invention claimed is:

1. A roll feeder for producing a series of sheet groups in which a plurality of sheets which are obtained by continuously cutting a belt-shaped material are arranged in a partially overlapped manner, the roll feeder comprising:

a first conveyer that conveys the belt-shaped material;

a rotary cutter that continuously cuts the belt-shaped material conveyed by the first conveyer into a plurality of sheets;

a second conveyer, composed of a belt member, that conveys the sheets, cut respectively, at a conveying speed higher than that of the first conveyer while sucking the sheets from a lower side thereof during the conveyance;

a lift member that pushes upward a tail end portion of each of the cut sheets conveyed by the second conveyer;

a third conveyer, composed of a belt member, that conveys the sheets at a conveying speed lower than that of the second conveyer while sucking the tail end portion of each of the cut sheets pushed upward by the lift member;

a fourth conveyer that receives the respective sheets conveyed by the third conveyer; and a stop member that is provided on a conveyance path of the fourth conveyer so as to temporarily stop and hold a lead end portion of the cut sheet conveyed by the third conveyer, wherein the third conveyer includes a suction roller that sucks the tail end portion of each sheet pushed upward by the lift member so as to bend the tail end portion to roll back the tail end portion upward.

2. The roll feeder according to claim 1, further comprising a controller that controls conveying speed of the sheets by the second and third conveyers so as to control a margin amount of partially overlapping sheets in a conveying direction.

* * * * *